US007710330B2

(12) United States Patent
Huang

(10) Patent No.: US 7,710,330 B2
(45) Date of Patent: May 4, 2010

(54) DUAL-BAND INVERTED-F ANTENNA

(75) Inventor: Chien-Lin Huang, Jhongli (TW)

(73) Assignee: Smart Approach Co., Ltd., Hsinchu (TW)

( * ) Notice: Subject to any disclaimer, the term of this patent is extended or adjusted under 35 U.S.C. 154(b) by 126 days.

(21) Appl. No.: 12/055,176

(22) Filed: Mar. 25, 2008

(65) Prior Publication Data

US 2009/0243936 A1 Oct. 1, 2009

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702
See application file for complete search history.

(56) References Cited

U.S. PATENT DOCUMENTS 7,489,278 B2 * 2/2009 Huang ..... 343/702
2003/0206136 A1 * 11/2003 Chen ..... 343/702

* cited by examiner

*Primary Examiner*—Hoang V Nguyen
(74) *Attorney, Agent, or Firm*—Workman Nydegger

(57) ABSTRACT

A dual-band inverted-F antenna including a radiation element, a ground element, a conductive pin, and a signal feed-in portion is described. The radiation element includes a loop portion, a first radiation portion, and a second radiation portion. After being fed in through the signal feed-in portion, a first band signal and a second band signal are wirelessly transmitted/received by the first radiation portion and the second radiation portion respectively in one aspect, and transmitted to the conductive pin through the loop portion and finally to the ground element in another aspect. The loop portion is directly short-grounding, such that the bandwidths of the first and the second band signals in operation are increased, thereby improving the overall radiation efficiency.

5 Claims, 6 Drawing Sheets

| | | | Frequency(MHz) | Average Gain(dB) | Efficiency(%) |
|---|---|---|---|---|---|
| WWAN | 800 | Transmit | 824 | -3.1 | 49% |
| | | | 836 | -2.63 | 55% |
| | | | 849 | -2.34 | 58% |
| | | Receive | 869 | -2.05 | 62% |
| | | | 880 | -2.38 | 58% |
| | | | 894 | -2.94 | 51% |
| | 900 | Transmit | 880 | -2.05 | 62% |
| | | | 900 | -2.36 | 58% |
| | | | 915 | -3.81 | 42% |
| | | Receive | 925 | -4.57 | 35% |
| | | | 940 | -5.03 | 31% |
| | | | 960 | -5.58 | 28% |

FIG.5

| | | | Frequency(MHz) | Average Gain(dB) | Efficiency(%) |
|---|---|---|---|---|---|
| WWAN | 1800 | Transmit | 1710 | -3.16 | 48% |
| | | | 1750 | -3.28 | 47% |
| | | | 1785 | -4.01 | 40% |
| | | Receive | 1805 | -4.33 | 37% |
| | | | 1840 | -3.12 | 49% |
| | | | 1880 | -3.22 | 48% |
| | 1900 | Transmit | 1850 | -3.29 | 47% |
| | | | 1880 | -3.2 | 48% |
| | | | 1910 | -2.82 | 52% |
| | | Receive | 1930 | -3.45 | 45% |
| | | | 1960 | -3.14 | 49% |
| | | | 1990 | -3.65 | 43% |
| | IMT 2000 | Transmit | 1920 | -2.76 | 53% |
| | | | 1950 | -2.88 | 52% |
| | | | 1980 | -3.66 | 43% |
| | | Receive | 2110 | -2.94 | 51% |
| | | | 2140 | -3.87 | 41% |
| | | | 2170 | -5.06 | 31% |

FIG.6

DUAL-BAND INVERTED-F ANTENNA

BACKGROUND OF THE INVENTION

1. Field of Invention

The present invention relates to an inverted-F antenna, and more particularly to a dual-band inverted-F antenna.

2. Related Art

Wireless communication technology employing electromagnetic waves to transmit signals does not need connecting wires for communicating with remote devices. Thereby, products applying the wireless communication technology are advantageous in portability, and thus the types thereof are increasingly growing, such as mobile phones and notebook computers. Further, as these products transmit signals through electromagnetic waves, an antenna for transmitting/receiving electromagnetic wave signals has become essential. Currently, an antenna is mainly exposed out of or built in a device. However, the antenna exposed out of a device not only affects the size and appearance of the product, but is also easily bent or fractured under the impact of an external force, so the built-in antenna has become a trend.

As for a current 3C device, in order to achieve multi-functions, a Wi-Fi antenna is further mounted in addition to a 3G wireless communication antenna. Along with the trend of developing smaller and more sophisticated 3C products, the space for disposing antennae is gradually reduced, and thus adjacent antennae may interfere with each other. As a result, the above situation may directly lead to a decrease of the radiation efficiency of the antennae and affect the signal quality.

FIG. 1 is a schematic view of a conventional inverted-F antenna. The inverted-F antenna has a striped radiation element 1, a sheet-like ground element 2 spaced from and facing the radiation element, and a conductive pin 3 and a signal feed-in portion 4 located between the radiation element 1 and the ground element 2. The conductive pin 3 connects one end of the radiation element 1 to the ground element 2 for functioning as a grounding pin. The signal feed-in portion 4 is disposed at a central position between two ends of the radiation element 1, for receiving signals fed in through a signal line 5. When the signal feed-in portion 4 receives a fed-in current from the signal line 5, the current is split to flow in the left and right directions. When the current directly flows toward the conductive pin 3 from the signal feed-in portion 4, as the current flows in opposite directions through the signal feed-in portion 4 and the conductive pin 3, the current on the left path is counteracted without causing any resonance to generate electromagnetic waves. The length of the right path is equivalent to that of the right side of the signal feed-in portion 4 in the radiation element 1, i.e., approximately a quarter wavelength. Therefore, electromagnetic waves at a specific frequency may be generated. Then, electromagnetic signals at the frequency are further induced, and the induced signals are transmitted to the signal line 5 through the signal feed-in portion 4 so as to be conducted out.

Thereby, the conventional inverted-F antenna can only transmit/receive mono-band signals, and fails to meet the multiplexing requirements. Meanwhile, if the inverted-F antenna is disposed adjacent to others, the radiation efficiency thereof may be affected.

SUMMARY OF THE INVENTION

In order to solve the above problems, the present invention is directed to a dual-band inverted-F antenna, which employs different radiation portions to transmit/receive signals of different bands, and adopts the design of a loop portion on the radiation element to improve the overall radiation efficiency.

A dual-band inverted-F antenna including a radiation element, a ground element, a conductive pin, and a signal feed-in portion is provided. The radiation element includes a loop portion, a first radiation portion, and a second radiation portion. The loop portion serves as a short-circuit loop. The first radiation portion is connected to the loop portion, for wirelessly transmitting/receiving a first band signal. The second radiation portion has one end connected to the loop portion, and the other end extending toward the first radiation portion, for wirelessly transmitting/receiving a second band signal. The ground element is spaced from and faces the radiation element. The conductive pin, located between the radiation element and the ground element, has two ends connected to the radiation element and the ground element respectively. The signal feed-in portion is connected to the loop portion, for feeding in the first band signal and the second band signal to the loop portion, then transmitting the signals to the first radiation portion, the second radiation portion, and the conductive pin through the loop portion, and receiving the first and the second band signals fed out from the first radiation portion and the second radiation portion through the loop portion respectively.

In the dual-band inverted-F antenna provided by the present invention, the first radiation portion and the second radiation portion of the radiation element are used for transmitting/receiving the first band signal and the second band signal respectively. Further, the design of a loop portion on the radiation element is adopted, such that after being fed in through the signal feed-in portion, the first band signal and the second band signal are wirelessly transmitted/received by the first radiation portion and the second radiation portion respectively in one aspect, and directly transmitted to the ground element through the conductive pin in another aspect, so as to achieve the effect of a short-circuit loop. Thereby, bandwidths of the first and the second band signals in operation are increased, and the overall radiation efficiency is enhanced.

BRIEF DESCRIPTION OF THE DRAWINGS

The present invention will become more fully understood from the detailed description given herein below for illustration only, and thus are not limitative of the present invention, and wherein:

FIG. 5 is a table showing average gains and efficiencies of the dual-band inverted-F antenna of the present invention measured at low frequencies; and FIG. 6 is a table showing average gains and efficiencies of the dual-band inverted-F antenna of the present invention measured at high frequencies.

DETAILED DESCRIPTION OF THE INVENTION

The features and practice of the present invention will be illustrated in detail below with the accompanying drawings.

Figure 1:
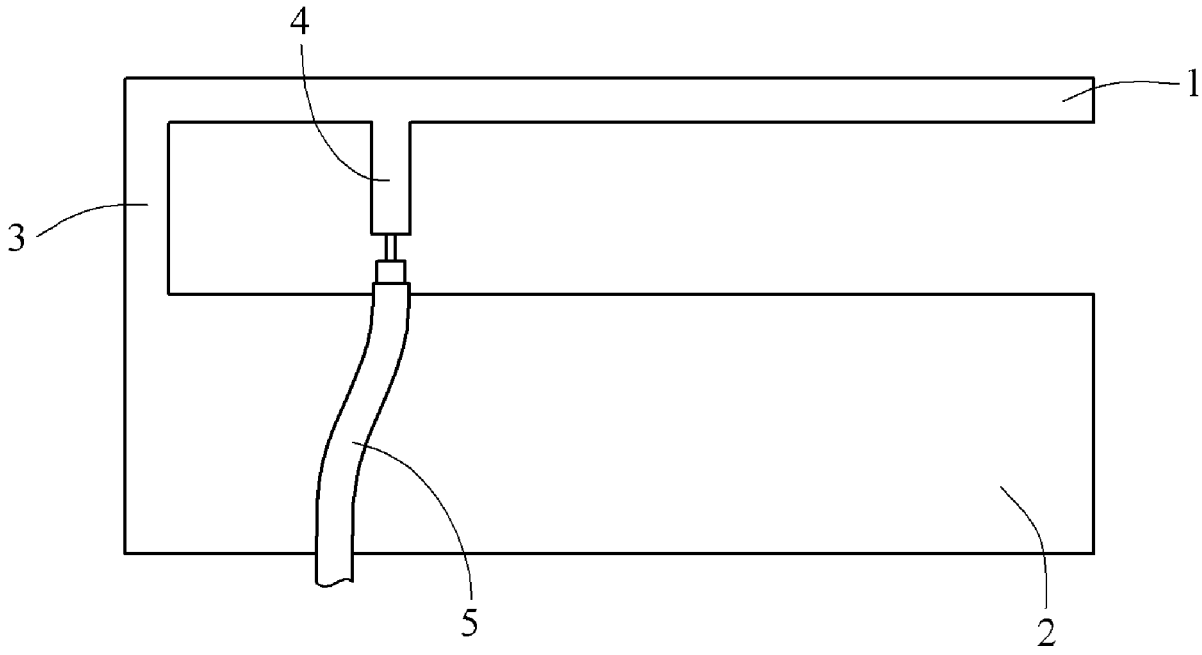
FIG.1 (PRIOR ART)
FIG. 1 is a schematic view of a conventional inverted-F antenna.
Figure 2:
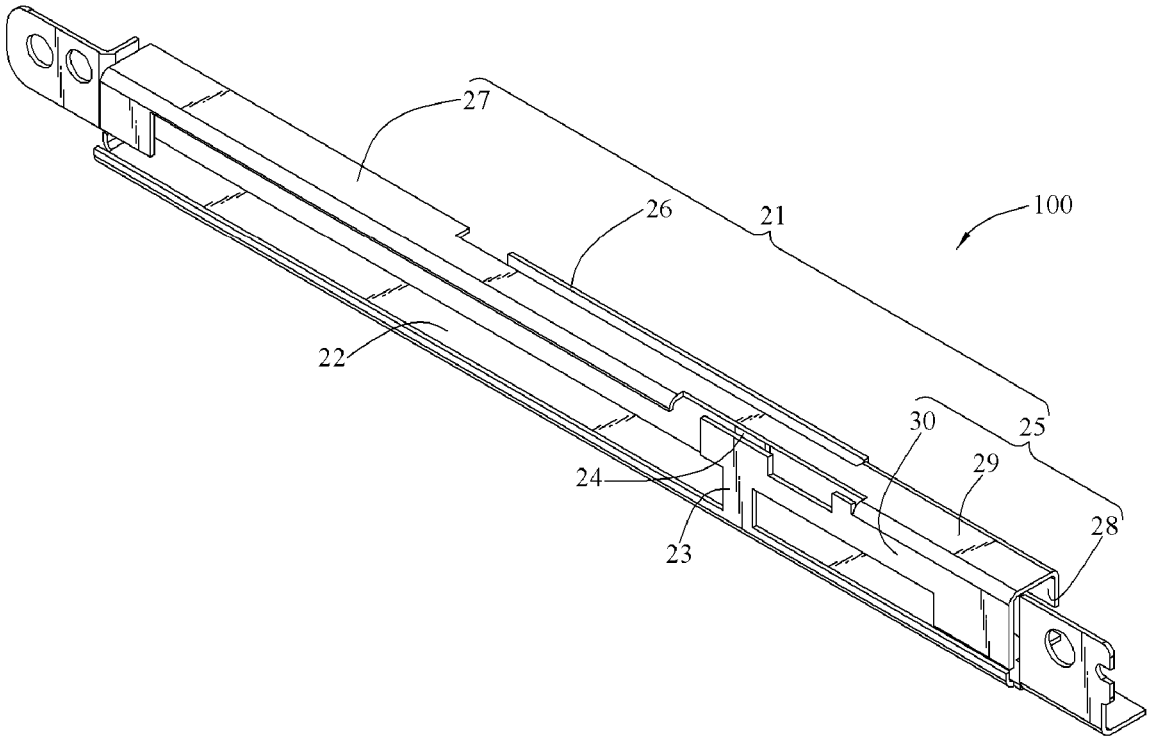
FIG. 2 is a schematic front view of a dual-band inverted-F antenna according to the present invention.
Figure 3:
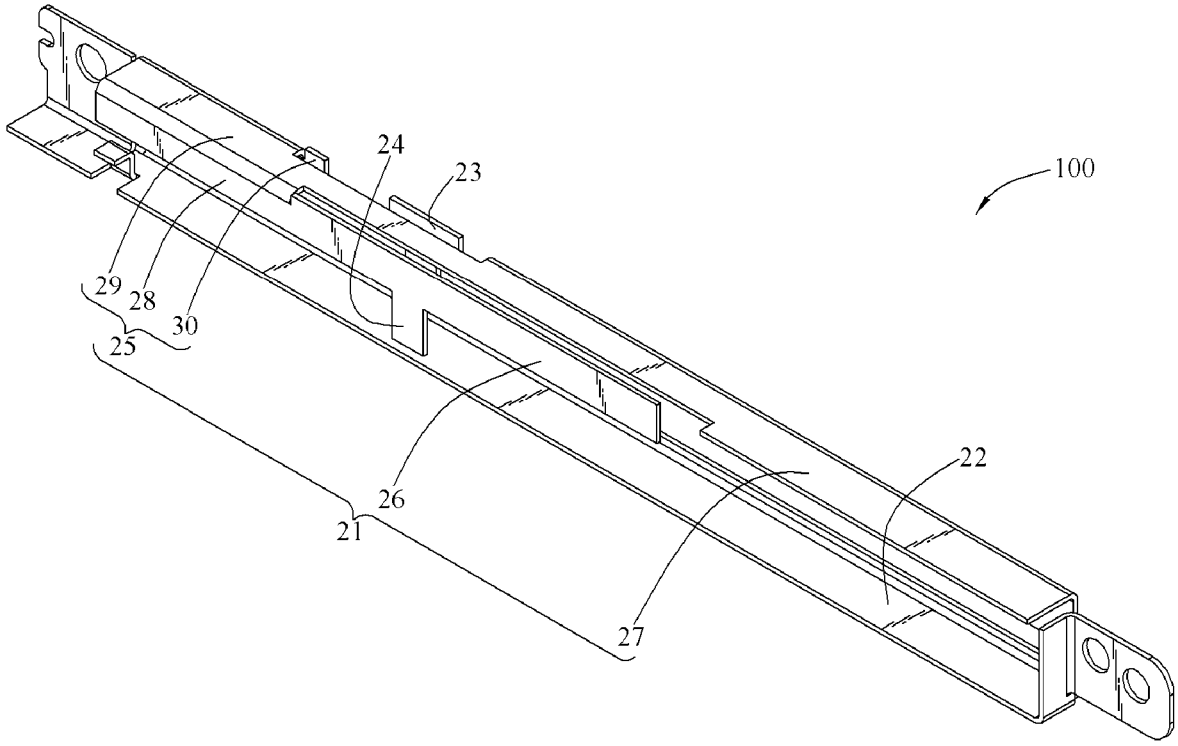
FIG. 3 is a schematic back view of a dual-band inverted-F antenna according to the present invention.

Referring to FIGS. 2 and 3, FIG. 2 is a schematic front view of a dual-band inverted-F antenna according to the present invention, and FIG. 3 is a schematic back view of a dual-band inverted-F antenna according to the present invention. The dual-band inverted-F antenna 100 includes a radiation element 21, a ground element 22, a conductive pin 23, and a signal feed-in portion 24.

The radiation element 21 includes a loop portion 25, a first radiation portion 26, and a second radiation portion 27. The loop portion 25 serves as a short-circuit loop. The first radiation portion 26 is connected to the loop portion 25, for wirelessly transmitting/receiving a first band signal. The second radiation portion 27 has one end connected to the loop portion 25, and the other end extending toward the first radiation portion 26, for wirelessly transmitting/receiving a second band signal. The radiation element 21 is used for wirelessly transmitting/receiving the first and the second band signals. The radiation element 21 is divided into the first radiation portion 26 resonating at the first band signal and the second radiation portion 27 resonating at the second band signal. A length of the first radiation portion 26 is equal to a quarter wavelength of the first band signal, and a length of the second radiation portion 27 is equal to a quarter wavelength of the second band signal. The resonance frequency of the first radiation portion 26 or the second radiation portion 27 may be altered by adjusting the length thereof.

The loop portion 25 includes a first metal plate 28, a second metal plate 29, and a third metal plate 30. The first metal plate 28, with one side connected to the signal feed-in portion 24, has one end connected to the first radiation portion 26, for receiving the first band signal and the second band signal fed in by the signal feed-in portion 24, and transmitting the first band signal to the first radiation portion 26. The second metal plate 29, with one side perpendicularly connected to the first metal plate 28, has one end connected to the second radiation portion 27. In addition, the second metal plate 29 is parallel to the ground element 22, for transmitting the second band signal transmitted by the first metal plate 28 to the second radiation portion 27. The third metal plate 30, perpendicularly connected to the second metal plate 29, extends toward the ground element 22 so as to be connected to the conductive pin 23, for transmitting the first band signal and the second band signal fed in by the signal feed-in portion 24 to the conductive pin 23. Thereby, the operating bandwidths of the first and the second band signals are increased.

The ground element 22 is a sheet-like ground element spaced from and facing the radiation element 21.

The conductive pin 23, located between the radiation element 21 and the ground element 22, has two ends connected to the radiation element 21 and the ground element 22 respectively.

The signal feed-in portion 24 is connected to the loop portion 25, for feeding in the first band signal and the second band signal to the loop portion 25, then transmitting the signals to the first radiation portion 26, the second radiation portion 27, and the conductive pin 23 through the loop portion 25, and receiving the first and the second band signals fed out from the first radiation portion 26 and the second radiation portion 27 through the loop portion 25 respectively.

After being fed into the dual-band inverted-F antenna 100 through the signal feed-in portion 24, the first band signal and the second band signal are wirelessly transmitted/received by the first radiation portion 26 and the second radiation portion 27 of the radiation element 21 respectively in one aspect, and transmitted to the conductive pin 23 through the loop portion 25 and finally to the ground element 22 in another aspect.

After being fed in by the signal feed-in portion 24, the signals are transmitted to the ground element 22 through the loop portion 25. The adoption of the short-circuit loop may increase the bandwidths of the signals in operation, and enhance the overall radiation efficiency. For the dual-band inverted-F antenna of the present invention, the operating bandwidth at the first band signal is from 1710 to 2170 MHz, and the operating bandwidth at the second band signal is from 824 to 960 MHz.

Figure 4:
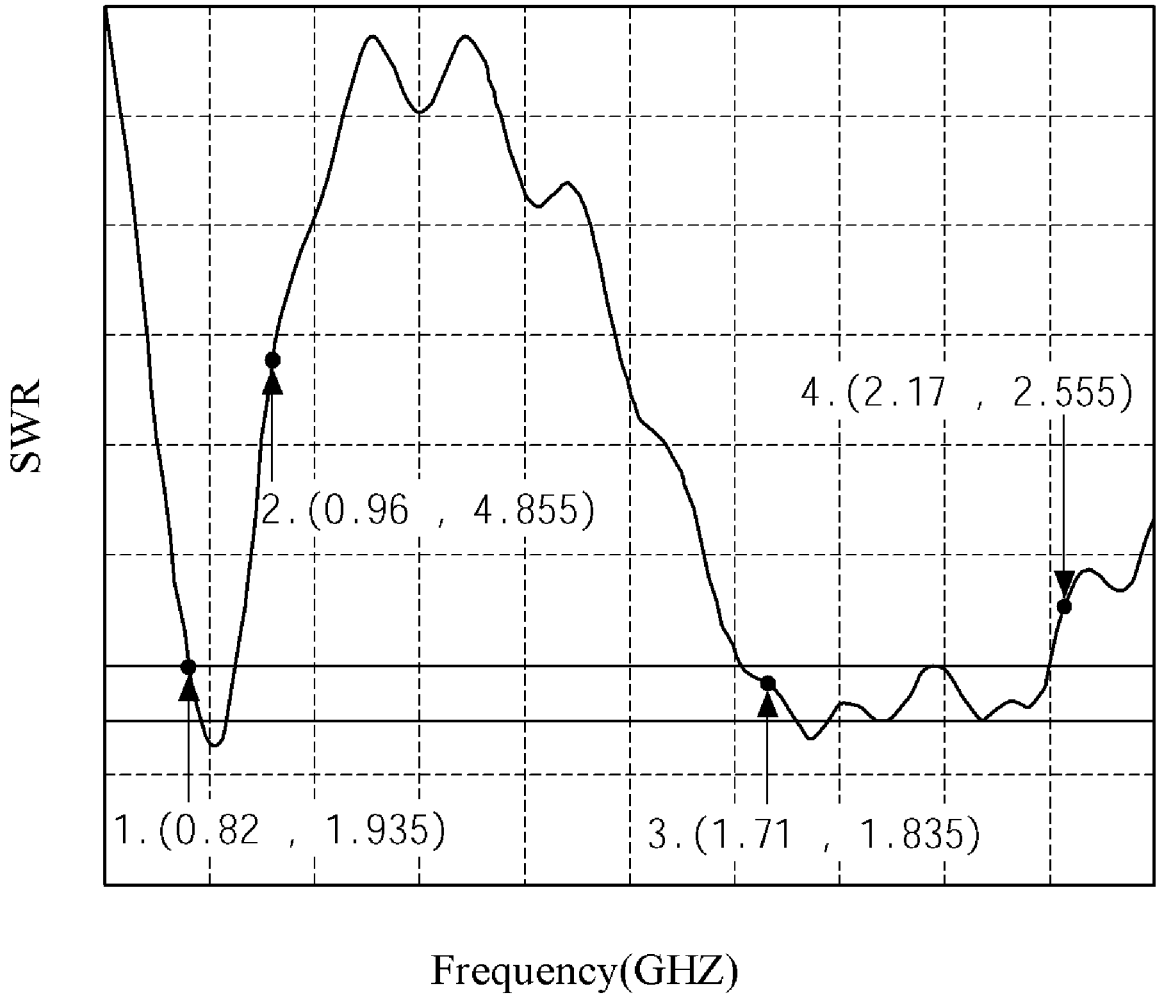
FIG. 4 is a measurement diagram of SWR of the dual-band inverted-F antenna according to the present invention.

FIG. 4 is a measurement diagram of standing wave ratio (SWR) of the dual-band inverted-F antenna according to the present invention. Referring to FIG. 4, SWRs measured at low frequencies (from 824 MHz to 960 MHz) and high frequencies (from 1710 MHz to 2170 MHz) are shown. It can be seen from FIG. 4 that, at the low frequencies (from 824 MHz to 960 MHz), the maximum SWR is below 5, and at the high frequencies (from 1710 MHz to 2170 MHz), the maximum SWR is approximately 2.5.

FIG. 5 is a table showing average gains and efficiencies of the dual-band inverted-F antenna of the present invention measured at low frequencies. Referring to FIG. 5, average gains and efficiencies of the dual-band inverted-F antenna during transmission/reception at various frequencies when applied in wireless wide area network (WWAN) systems 800 and 900 are shown. It can be seen from FIG. 5 that, the dual-band inverted-F antenna of the present invention may increase the original operating bandwidths from 850-900 MHz to 824-960 MHz, and the average gain and efficiency at each frequency are acceptable.

FIG. 6 is a table showing average gains and efficiencies of the dual-band inverted-F antenna of the present invention measured at high frequencies. Referring to FIG. 6, average gains and efficiencies of the dual-band inverted-F antenna during transmission/reception at various frequencies when applied in WWAN systems 800, 900, and International Mobile Telecommunication (IMT) 2000 are shown. It can be seen from FIG. 6 that, the dual-band inverted-F antenna of the present invention may increase the original operating bandwidths from 1900-2000 MHz to 1710-2170 MHz, and the average gain and efficiency at each frequency are acceptable.

What is claimed is:

1. A dual-band inverted-F antenna, comprising:

a radiation element, comprising:

a loop portion;

a first radiation portion, connected to the loop portion, for wirelessly transmitting/receiving a first band signal; and a second radiation portion, having one end connected to the loop portion and the other end extending toward the first radiation portion, for wirelessly transmitting/receiving a second band signal;

a ground element, spaced from and facing the radiation element;

a conductive pin, located between the radiation element and the ground element, and having two ends connected to the radiation element and the ground element respectively; and a signal feed-in portion, connected to the loop portion, for feeding in the first band signal and the second band signal to the loop portion, then transmitting the signals to the first radiation portion, the second radiation portion, and the conductive pin through the loop portion, and receiving the first and the second band signals fed out from the first radiation portion and the second radiation portion through the loop portion respectively, wherein the loop portion comprises:

a first metal plate, connected to the signal feed-in portion, and having one end connected to the first radiation portion, for receiving the first band signal and the second band signal fed in by the signal feed-in portion, and transmitting the first band signal to the first radiation portion;

a second metal plate, with one side perpendicularly connected to the first metal plate, and having one end connected to the second radiation portion, wherein the second metal plate is parallel to the ground element, for transmitting the second band signal transmitted by the first metal plate to the second radiation portion; and a third metal plate, perpendicularly connected to the second metal plate, and perpendicularly extending toward the ground element so as to be connected to the conductive pin.

2. The dual-band inverted-F antenna as claimed in claim 1, wherein a length of the first radiation portion is equal to a quarter wavelength of the first band signal.

3. The dual-band inverted-F antenna as claimed in claim 1, wherein a length of the second radiation portion is equal to a quarter wavelength of the second band signal.

4. The dual-band inverted-F antenna as claimed in claim 1, wherein an operating bandwidth of the first band signal is from 1700 to 2170 MHz.

5. The dual-band inverted-F antenna as claimed in claim 1, wherein an operating bandwidth of the second band signal is from 824 to 960 MHz.

* * * * *